US010184720B2

(12) United States Patent
Binder et al.

(10) Patent No.: US 10,184,720 B2
(45) Date of Patent: Jan. 22, 2019

(54) DEVICE AND METHOD FOR DRYING WORK PIECES

(75) Inventors: Dietmar Binder, Holzgerlingen (DE); Ulrich Hofbauer, Gaeufelden (DE)

(73) Assignee: EISENMANN SE, Boeblingen (DE)

( * ) Notice: Subject to any disclaimer, the term of this patent is extended or adjusted under 35 U.S.C. 154(b) by 1330 days.

(21) Appl. No.: 14/116,802

(22) PCT Filed: Apr. 28, 2012

(86) PCT No.: PCT/EP2012/001844
§ 371 (c)(1),
(2), (4) Date: Jan. 30, 2014

(87) PCT Pub. No.: WO2012/152391
PCT Pub. Date: Nov. 15, 2012

(65) Prior Publication Data

US 2014/0137427 A1 May 22, 2014

(30) Foreign Application Priority Data

May 12, 2011 (DE) ..... 10 2011 101 277

(51) Int. Cl.
*F26B 25/00* (2006.01)
*F26B 15/08* (2006.01)
*F26B 15/18* (2006.01)

(52) U.S. Cl.
CPC ..... *F26B 25/003* (2013.01); *F26B 15/08* (2013.01); *F26B 15/18* (2013.01)

(58) Field of Classification Search
CPC ..... C11D 1/83; C11D 1/86; C11D 3/2086; C11D 3/30; C11D 3/3418; C13B 45/02; F26B 25/003; F26B 15/08; F26B 15/18
(Continued)

(56) References Cited

U.S. PATENT DOCUMENTS 2,152,312 A * 3/1939 Jennings ..... C14B 1/26 34/203
2,530,595 A * 11/1950 Blaha ..... F27B 9/16 198/773

(Continued)

FOREIGN PATENT DOCUMENTS

DE 41 27 580 C1 2/1993
DE 10 2007 046 322 A1 4/2009

(Continued)

*Primary Examiner* — Jessica Yuen
(74) *Attorney, Agent, or Firm* — Schroeder Intellectual Property Law Group, LLC

(57) ABSTRACT

A device for drying work pieces, in particular vehicle wheels, having a dryer housing which borders a dryer chamber and has at least one access to the dryer chamber. Work piece carriers loaded with work pieces can be conveyed through the dryer chamber by a conveyance system. There is a transfer device which transfers work pieces to be dried to a work piece carrier located in the dryer chamber, and removes dried work pieces by a work piece carrier located in the dryer chamber. The work piece carriers can be conveyed in circulation through the dryer chamber without leaving same. A method for drying work pieces, wherein the work piece carriers are correspondingly conveyed through the dryer chamber without leaving same, wherein work pieces to be dried are transferred to a work piece carrier located in the dryer chamber and dried work pieces are removed by a work piece carrier located in the dryer chamber.

17 Claims, 5 Drawing Sheets

(58) Field of Classification Search
USPC ..... 34/186, 194, 203, 223, 229, 236, 267, 34/284, 304, 328, 380, 418; 510/189; 53/122; 432/82
See application file for complete search history.

(56) References Cited

U.S. PATENT DOCUMENTS

| | | | | |
|---|---|---|---|---|
| 2,622,344 | A | 12/1952 | Newman | |
| 2,732,627 | A * | 1/1956 | Fava | F26B 15/126 34/207 |
| 2,757,497 | A * | 8/1956 | Chambon | C13B 45/02 100/907 |
| 6,418,636 | B1 | 7/2002 | Sonner | |
| 2005/0239011 | A1 | 10/2005 | Buchmann et al. | |
| 2007/0117732 | A1* | 5/2007 | Minevski | C11D 1/83 510/189 |

FOREIGN PATENT DOCUMENTS

| | | | |
|---|---|---|---|
| EP | 1 076 218 | A1 | 2/2001 |
| EP | 1 582 831 | A2 | 10/2005 |

* cited by examiner

DEVICE AND METHOD FOR DRYING WORK PIECES

RELATED APPLICATIONS

This application claims the filing benefit of International Patent Application No. PCT/EP2012/001844, filed on Apr. 28, 2012, which claims the filing benefit of German Patent Application No. 10 2011 101 277.3, filed May 12, 2011, the contents of both of which are incorporated herein by reference.

FIELD OF THE INVENTION

The invention relates to a device for drying workpieces, in particular vehicle wheels, comprising:

a) a dryer housing which borders a dryer chamber and has at least one access to the dryer chamber;

b) a conveying system by means of which workpiece-carriers loaded with workpieces can be conveyed through the dryer chamber.

The invention also relates to a method for drying workpieces, in particular vehicle wheels, in which workpiece-carriers loaded with workpieces are conveyed through a dryer chamber.

BACKGROUND OF THE INVENTION

Devices and methods of this kind which are known from the market are used, for example, in order to dry freshly painted workpieces, or even workpieces whose surface has been treated in some other way, in a drying oven. This should also be understood to include, in the present case, the stoning of powder coatings onto workpieces.

In the present case, vehicle wheels are mentioned as an example of the workpieces to be dried. However, the workpieces to be dried may also be other assemblies and components which may also be produced from non-metallic materials, in particular from plastic. If the components in question are fairly small parts, these may be accommodated in a carrying basket or the like which may be fastened to the workpiece-carrier.

In the case of drying ovens and methods which are known from the market for the purpose of drying vehicle wheels, it is usual for a number of vehicle wheels to arrive from a preceding treatment on a workpiece-carrier and then to be conveyed, also on the latter, through the dryer chamber. Under these circumstances, temperatures of, for example, about 180° C. prevail, at least in a drying zone.

After the vehicle wheels have passed through the dryer chamber and the drying process in the drying oven has been completed, the vehicle wheels are conveyed out of the dryer chamber again, together with the workpiece-carrier. This means that the workpiece-carriers are conveyed together with the vehicle wheels as they pass through the dryer chamber.

On each occasion, therefore, it is also necessary to heat up the workpiece-carrier with the vehicle wheels, or workpieces in general, that are to be dried, which workpiece-carrier also cools down again with the workpieces after passing through the drying oven.

Depending upon the ratio between the weight of the workpiece-carrier and the weight of the workpieces on said workpiece-carrier, a considerable portion of energy is consumed for the purpose of heating up the workpiece-carrier in the course of each drying operation, a fact which significantly impairs the overall energy balance of the drying device with respect to the workpieces to be dried, and thus increases the overall running costs of the installation.

It is therefore an object of the invention to provide a device and a method for drying workpieces of the kind initially mentioned, in which the energy balance is improved.

SUMMARY OF THE INVENTION

This object may be achieved, in the case of a device of the kind initially mentioned, through the fact that:

c) a transposing apparatus is present, by means of which:

ca) workpieces to be dried can be transferred to a workpiece-carrier which is located in the dryer chamber; and cb) dried workpieces can be removed from a workpiece-carrier which is located in said dryer chamber;

so that d) the workpiece-carriers can be conveyed in circulation through the dryer chamber without leaving said chamber.

What is achieved, according to the invention, as a result of these measures is that the workpiece-carriers are heated up only when the device starts up and then remain within an operating temperature range. Although, under these circumstances, the operating temperature of the workpiece-carriers can fluctuate within a range of several tens of degrees C., said workpiece-carriers nevertheless no longer have to be heated up from, say, ambient temperature to the operating temperature in the dryer chamber every time workpieces pass through, as is the case if the workpiece-carriers are conveyed with the workpieces as they pass through the device. As a result of this, a smaller portion, in total, of the overall energy which is needed for drying the workpieces is used for heating up the workpiece-carriers, as a result of which the energy balance of the installation is improved.

It is favourable if the dryer chamber comprises a pre-heating zone and a drying tunnel connected to the latter, whereby there prevails, in said pre-heating zone, a temperature which is lower than the temperature in the drying tunnel, and the pre-heating zone is accessible from outside via the at least one access. Since a heat loss occurs via the access, this can thus be kept lower than if the access were to lead directly to the drying tunnel having the higher temperature.

It is also of advantage, from a thermal technology point of view, if the drying tunnel is arranged at a different, in particular higher, vertical level than the pre-heating zone.

It is also advantageous if the drying tunnel is of two-storey construction and comprises a first tunnel conveyor and a second tunnel conveyor for workpiece-carriers, whereby the tunnel conveyors are arranged vertically one above the other and workpiece-carriers can be conveyed from the first tunnel conveyor to the second tunnel conveyor by means of a vertical transposing device. The path of the workpiece-carriers through the drying tunnel is thereby doubled, as a result of which efficient use is made of the available space, or the drying tunnel may optionally be built so as to be shorter than it would be without these measures.

In order to ensure effective circulation of the workpiece-carriers within the dryer chamber, it is favourable if a transfer apparatus having a vertically movable conveying carriage is arranged in the dryer chamber, by means of which apparatus workpiece-carriers can be conveyed out of the pre-heating zone and into the drying tunnel and vice versa, and the conveying carriage of which apparatus carries with it a first conveying support and a second conveying support which are arranged vertically one above the other, whereby it is possible to position the conveying carriage in such a way that the first conveying support is capable of cooperating with the first tunnel conveyor and the second conveying support is capable of cooperating with the second tunnel conveyor. It is thus possible, in one conveying cycle with two steps in the movement of the conveying carriage, to introduce a workpiece-carrier with workpieces to be dried into the drying tunnel and to bring a workpiece-carrier with dried workpiece-carriers out of said drying tunnel. In this case, the feeding of workpieces to be dried into the drying tunnel and the discharging of dried workpieces from said drying tunnel take place at one and the same end of the tunnel.

An alternative circulatory design may advantageously be realised if the vertical conveyor serves as a delivery apparatus, by means of which dried workpieces can be conveyed out of the drying tunnel via one end of the latter, and a feed apparatus is present by means of which workpieces to be dried can be conveyed out of the pre-heating zone and into the drying tunnel via the other end of said tunnel.

With respect to the method, the abovementioned object may be achieved through the fact that:

a) the workpiece-carriers are conveyed in circulation through the dryer chamber without leaving said chamber;

whereby:

b) workpieces to be dried are transferred to a workpiece-carrier which is located in the dryer chamber; and c) dried workpieces are removed from a workpiece-carrier which is located in said dryer chamber.

The advantages of this and of the measures explained below correspond, mutatis mutandis, to the advantages which have been discussed in connection with the corresponding measures in the case of the device.

Consequently, it is favourable if the workpiece-carriers are conveyed through a pre-heating zone and a drying tunnel connected to the latter, whereby there is generated in said pre-heating zone a temperature which is lower than the temperature in the drying tunnel, and the pre-heating zone is accessible from outside via the at least one access.

Under these circumstances, the drying tunnel is preferably arranged at a different, in particular higher, vertical level than the pre-heating zone.

Furthermore, it is of advantage if the workpiece-carriers are guided through the drying tunnel in two storeys by means of a first tunnel conveyor and a second tunnel conveyor which are arranged vertically one above the other, whereby the workpiece-carriers are conveyed from the first tunnel conveyor to the second tunnel conveyor by means of a vertical transposing device.

Under these circumstances, the workpiece-carriers are preferably conveyed out of the pre-heating zone and into the drying tunnel and vice versa by means of a transfer apparatus which comprises a conveying carriage having a first conveying support and a second conveying support which are arranged vertically one above the other, whereby the conveying carriage may be positioned in such a way that the first conveying support is capable of cooperating with the first tunnel conveyor and the second conveying support is capable of cooperating with the second tunnel conveyor.

Alternatively, dried workpieces are conveyed, by means of the vertical conveyor, out of the drying tunnel via one end of said tunnel, and workpieces to be dried are conveyed, by means of a feed apparatus, out of the pre-heating zone and into the drying tunnel via the other end of said tunnel.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in greater detail below with the aid of the drawings, in which.

DETAILED DESCRIPTION OF THE PRESENT INVENTION

Figure 1:
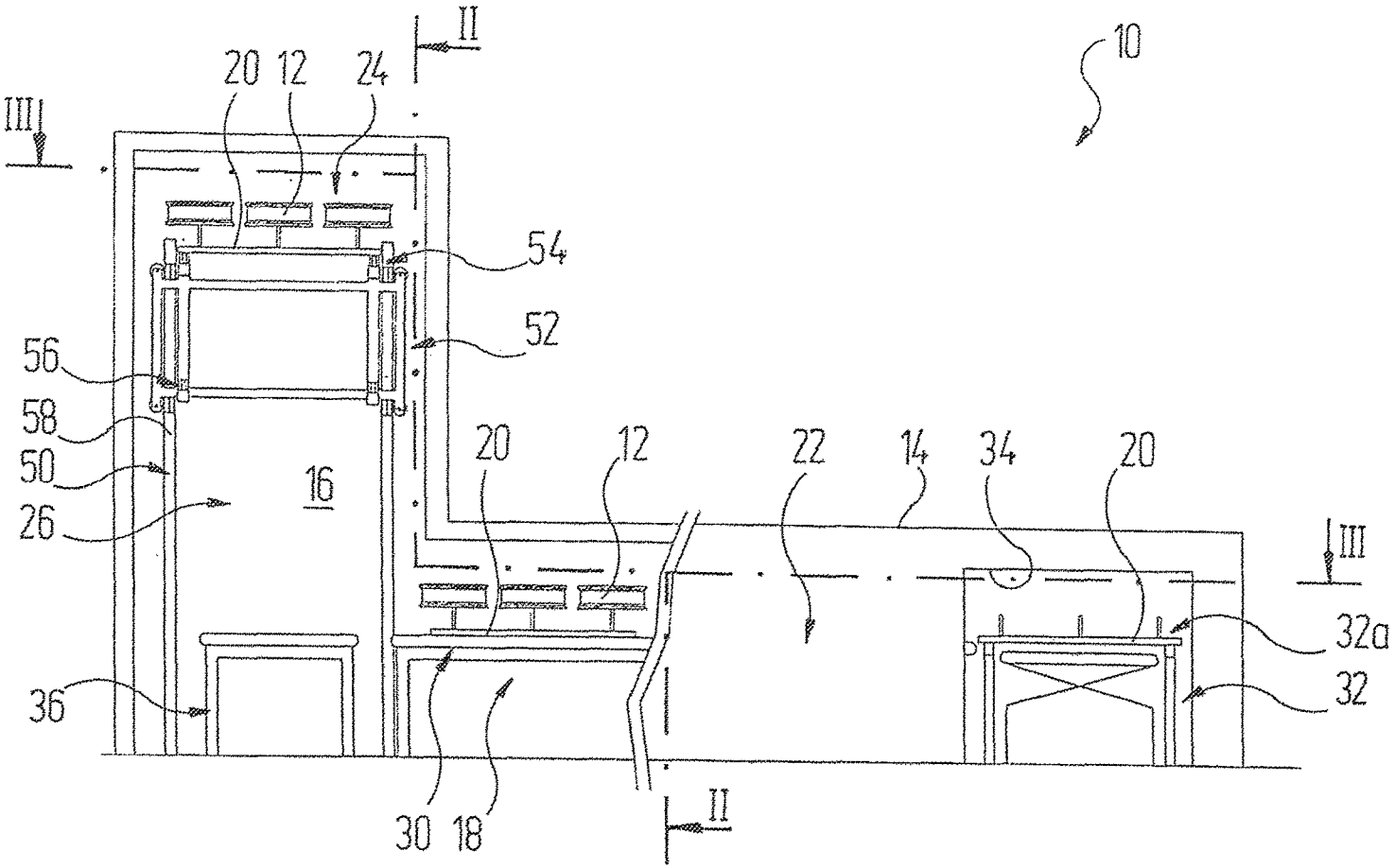
FIG. 1 shows a vertical section through a drying oven for vehicle wheels according to a first exemplary embodiment, along the sectional line I-I in FIGS. 2 and 3, which is angled in each case.
Figure 2:
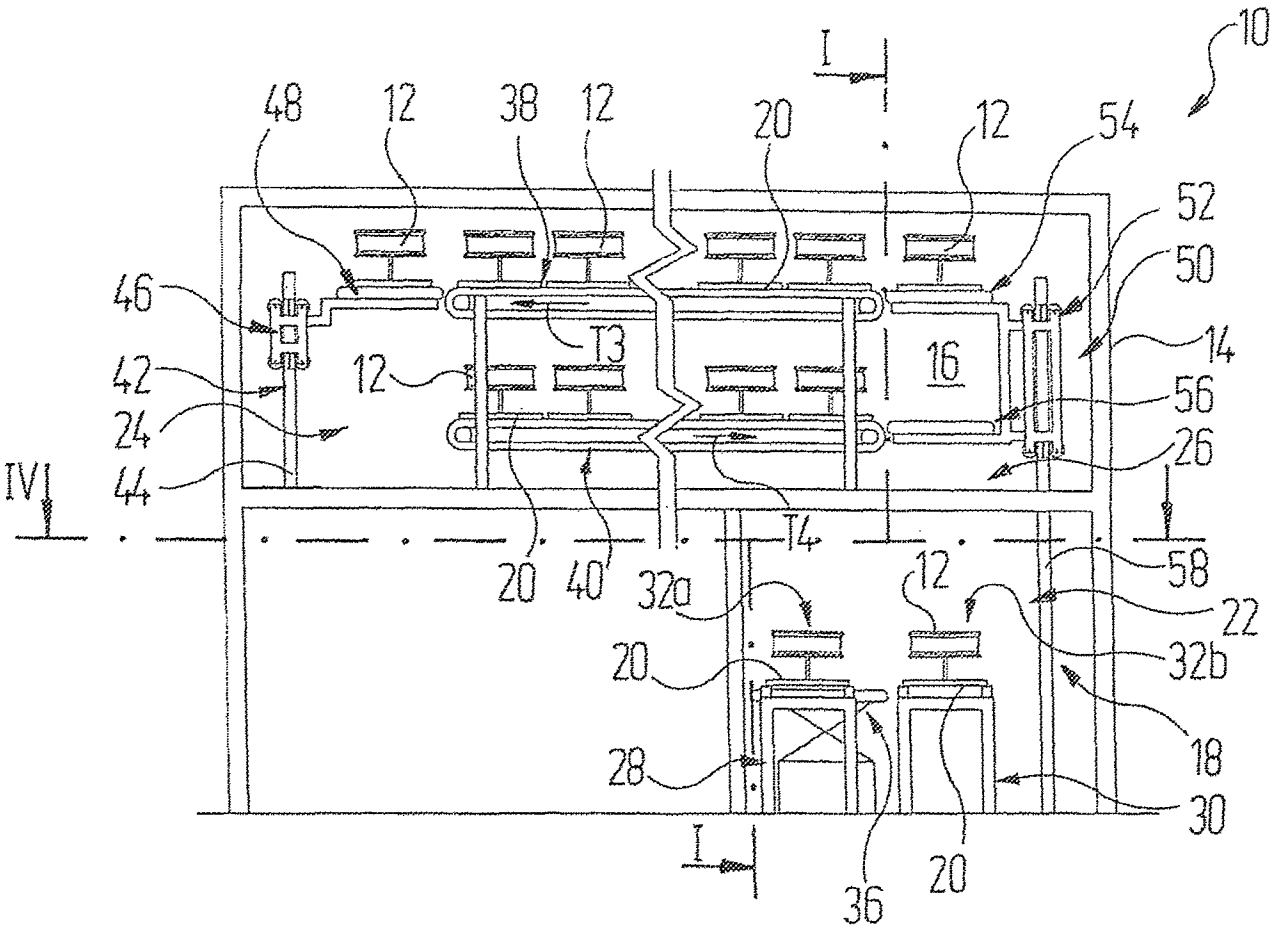
FIG. 2 shows a further vertical section through the drying oven, along the angled sectional line II-II in FIG. 1.
Figure 3:
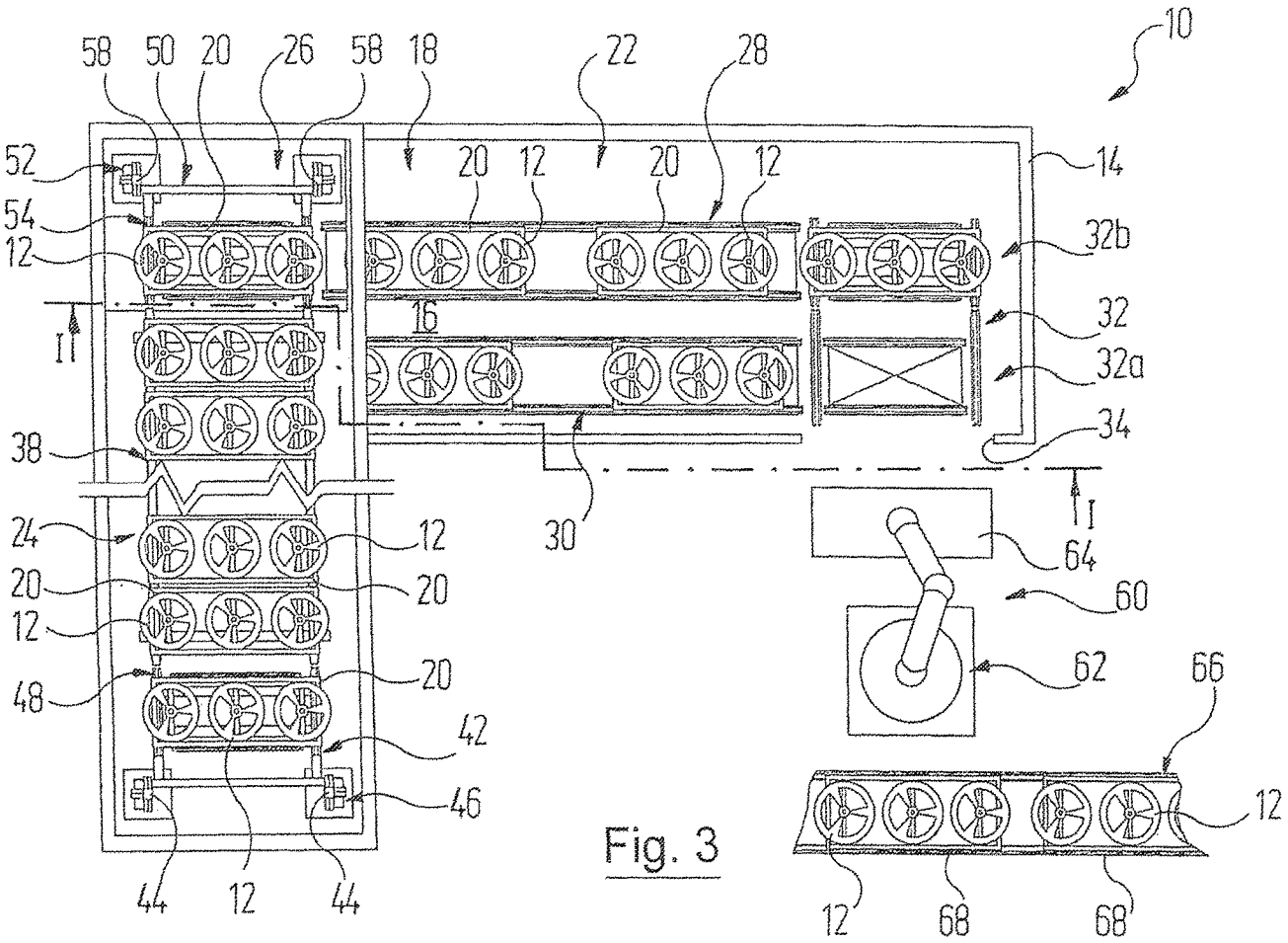
FIG. 3 shows a horizontal section through the drying oven, along the angled sectional line III-III in FIG. 1.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIGS. 1 to 4, a drying oven, in which workpieces are dried, is designated as a whole by 10 as a first exemplary embodiment of a device for drying objects. In the present exemplary embodiment, there are illustrated, as workpieces, vehicle wheels 12 for motor vehicles which are dried in the drying oven 10 after they have been provided, in one or more preceding treatment steps, with a surface coating, such as a paint for example.

The drying oven 10 comprises a thermally insulated dryer housing 14 which borders a dryer chamber 16. Workpiece-carriers 20, which are loaded with vehicle wheels 12, are conveyed through the dryer chamber 16 with the aid of a conveying system which is identified, as a whole, by 18. In the present exemplary embodiment, each workpiece-carrier 20 is capable of receiving three vehicle wheels 12.

The dryer chamber 16 of the drying oven 10 comprises a pre-heating and discharging zone 22 at a first vertical level, and a drying tunnel 24 which is located at a second vertical level that is higher than the first vertical level of the pre-heating and discharging zone 22. The pre-heating and discharging zone 22 and the drying tunnel 24 are connected to one another via a transfer chamber 26 belonging to the dryer chamber 16. A temperature of about 70° C. to 80° C. prevails in the pre-heating and discharging zone 22, whereas there is a temperature of about 180° C. in the drying tunnel 24. The temperatures are generated and maintained with the aid of heating apparatuses, such as are known per se and which are intentionally not shown for the sake of clarity.

The drying tunnel 24 thus constitutes the actual dryer chamber in which the desired drying operation runs its course and in which the highest temperature prevails inside the dryer housing 14.

Arranged parallel and side by side in the pre-heating and discharging zone 22 are a first chain conveyor 28 and a second chain conveyor 30 which extend from a transverse conveying station 32, which is located in front of an access 34 in the oven housing 14, to the transfer chamber 26. The dryer chamber 16 of the drying oven 10 is accessible from outside via the access 34. Chain conveyors are known per se in many variants, for which reason a detailed description will be dispensed with.

The first chain conveyor 28 serves as a feed conveyor and conveys workpiece-carriers 20 from the transverse conveying station 32 to the transfer chamber 26 in a direction of transport T1, while the second chain conveyor 30 serves as a discharging conveyor and conveys workpiece-carriers 20 from a transfer station 36 to the transverse conveying station 32 in a direction of transport T2.

Figure 4:
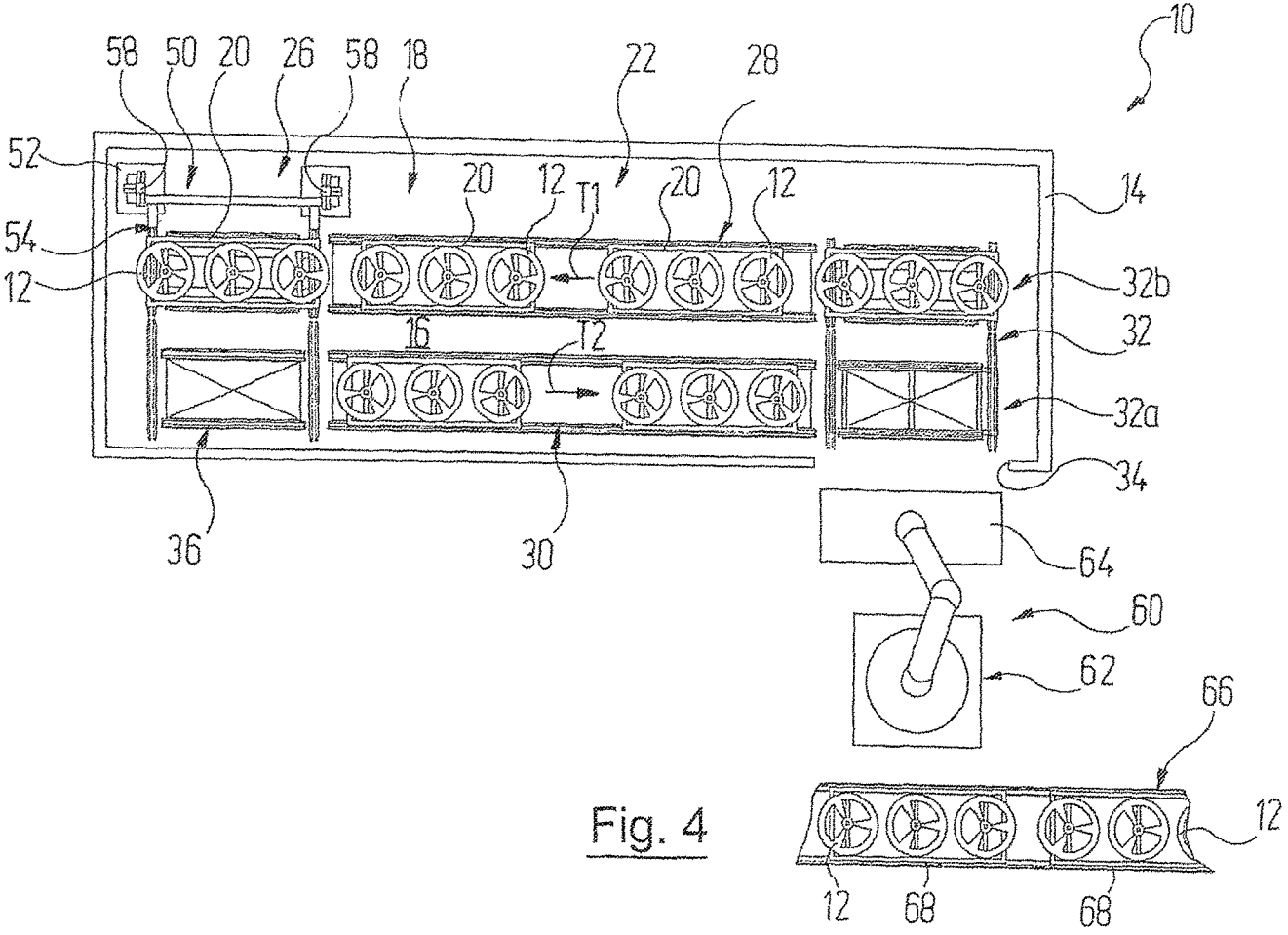
FIG. 4 shows a further horizontal section through the drying oven, along the sectional line IV-IV in FIG. 1.

The directions of transport T1 and T2 are shown only in FIG. 4 and extend parallel but accordingly define mutually opposed directions of transport. The transverse conveying station 32 and the transfer station 36 are also capable of conveying the workpiece-carriers 20 in directions perpendicular to the directions of transport T1 and T2, and comprise, for that purpose, raising/lowering platforms and conveying chains which cooperate in a manner known per se but which are intentionally not provided with a reference numeral.

Under these circumstances, the transverse conveying station 32 provides a first conveying position 32*a* and a second conveying position 32*b* for workpiece-carriers 20. In the first conveying position 32*a*, a workpiece-carrier 20 is arranged both next to the discharging conveyor 30 and next to the access 34 in the oven housing 14. In the second conveying position 32*b*, a workpiece-carrier 20 is arranged next to the feed conveyor 28 and next to the first conveying position 32*a*.

Arranged vertically one above the other in the drying tunnel 24 of the drying oven 10 are a first, upper and a second, lower tunnel conveyor, 38 and 40 respectively, for the workpiece-carriers 20, as a result of which the drying tunnel 24 comprises two storeys. These two tunnel conveyors 38, 40 are, once again, constructed as chain conveyors in a manner known per se and, in the present exemplary embodiment, extend, and effect conveying, in directions T3 and T4 which extend at right angles to the directions of transport T1 and T2 of the feed conveyor 28 and discharging conveyor 30, respectively, in the pre-heating and discharging zone 22, and extend in opposite directions to one another. The directions of transport T3 and T4 are shown only in FIG. 2. Under these circumstances, the workpiece-carriers 20 are conveyed transversely to their longitudinal direction.

The two tunnel conveyors 38, 40 extend between the transfer chamber 26 and a vertical conveyor in the form of a vertical transposing device 42 at the opposite end of the drying tunnel 24. With the aid of the vertical transposing device 42, workpiece-carriers 20 can be transposed from the upper tunnel conveyor 38 to the lower tunnel conveyor 40. For this purpose, the vertical transposing device 42 comprises a transposing carriage 46 which is capable of moving vertically on a vertical rail 44 and has a transposing support 48 and which is selectively oriented, in an upper receiving position of the transposing carriage 46, in a manner which is in alignment, for conveying purposes, with the upper tunnel conveyor 38 or, in a lower delivery position of said transposing carriage 46, in a manner which is in alignment, for conveying purposes, with the lower tunnel conveyor 40. In the present case, an "orientation or arrangement of two conveying components which is in alignment for conveying purposes" should be understood to mean that a workpiece-carrier 20 can then be transferred from one conveying component to another conveying component.

The transposing support 48 is capable of both receiving workpieces 12 from the upper tunnel conveyor 38 from the latter's direction of transport T3, and of delivering them to the lower tunnel conveyor 40 in the latter's direction of transport T4.

Arranged in the transfer chamber 26 of the drying oven 10 is a transfer apparatus 50 by means of which workpiece-carriers 20 can be lifted out of the pre-heating and discharginge zone 22 and into the drying tunnel 24, or lowered out of said drying tunnel 24 and into the pre-heating and discharginge zone 22.

The transfer apparatus 50 comprises a two-storey conveying carriage 52 which comprises an upper conveying support 54 and a lower conveying support 56 which is arranged directly below the latter and which corresponds, structurally, to the transposing support 48 belonging to the vertical transposing device 42 in the drying tunnel 24. The upper conveying support 54 is capable of delivering a workpiece-carrier 20 in the direction of the direction of transport T3 of the upper tunnel conveyor 38, while the lower conveying support 56 of the conveying carriage 52 is capable of receiving a workpiece-carrier 20 from the direction of the direction of transport T4 of the lower tunnel conveyor 40.

The conveying carriage 52 can be moved vertically along a guide structure 58, in which case three working positions are of interest.

In a first, uppermost working position, the upper conveying support 54 of the conveying carriage 52 is in alignment, for conveying purposes, with the upper tunnel conveyor 38, while the lower conveying support 56 of the conveying carriage 52 is in alignment, for conveying purposes, with the lower tunnel conveyor 40 in the drying tunnel 24. This working position of the conveying carriage 52 can be seen in FIG. 2.

In a second, central working position of the conveying carriage 52, the lower conveying support 56 of said carriage is in alignment, for conveying purposes, with the feed conveyor 28 in the pre-heating and discharging zone 22 and also with the transfer station 52 in the transfer chamber 26.

In a third, lowermost working position of the conveying carriage 52, the lower conveying support 56 of said carriage is in alignment, for conveying purposes, both with the feed conveyor 28 in the pre-heating and discharging zone 22 and also with the transfer station 36 in the transfer chamber 26.

Arranged in front of the access 34 in the dryer housing 14 to the dryer chamber 16 is a transposing apparatus 60 which, in the present exemplary embodiment, is constructed in the form of a multi-axis handling robot 62. Said handling robot 62 carries with it a gripping unit 64 which is represented only diagrammatically, which is adapted to the arrangement of the vehicle wheels 12 on the workpiece-carriers 20, and by means of which three vehicle wheels 12 can be received.

The handling robot 62 may, on the one hand, reach the conveying position 32*a* of the transverse conveyor 32 in the pre-heating and discharging zone 22 through the access 34. On the other hand, there is arranged, within the working range of the handling robot 62, a workpiece-conveyor 66 in the form of a further chain conveyor, with the aid of which vehicle wheels 12 to be dried are conveyed on workpiece-carriers 68 to the drying oven 10, and dried vehicle wheels 12 are conveyed, on the said workpiece-carriers 68, away from the drying oven 10.

The drying oven 10 described above is now operated as follows:

The arrangement, which is shown in FIGS. 1 to 4, of the individual conveying components and workpiece-carriers 20 with vehicle wheels 12 will be assumed as the starting situation. Accordingly, an unloaded workpiece-carrier 20 is located in the first conveying position 32*a* of the transverse conveying station 32, and a workpiece-carrier 20 loaded with vehicle wheels 12 is located in the second conveying position 32*b* of said station.

Located on the feed conveyor 28 are workpiece-carriers 20 with vehicle wheels 12 which are to be dried, while the discharging conveyor 30 conveys, on workpiece-carriers 20, vehicle wheels 12 which have already been dried.

Located on the tunnel conveyors 38 and 40 are workpiece-carriers 20 with vehicle wheels 12 which are just being dried.

The transposing support 48 of the transposing carriage 46 belonging to the vertical transposing device 42 has received a loaded workpiece-carrier 20 from the upper tunnel conveyor 38, whereby the transposing carriage 46 is still located in its upper receiving position.

The conveying carriage 52 of the transfer apparatus 50 assumes its uppermost working position, whereby its upper conveying support 54 carries a loaded workpiece-carrier 20 and its lower conveying support 56 is empty. The transfer station 36 is also empty.

A workpiece-carrier 68 with vehicle wheels 12 to be dried is positioned on the workpiece-conveyor 66 in front of the handling robot 62.

With the aid of its gripping unit 64, said handling robot 62 now receives these vehicle wheels 12 to be dried from the workpiece-carrier 68 and brings them into the pre-heating and discharging zone 22 through the access 34 in the dryer housing 14. There, it deposits the vehicle wheels 12 on the workpiece-carrier 20 in the first conveying position 32*a* of the transverse conveying station 32. The workpiece-carrier 68, which is now empty, on the workpiece-conveyor 66 remains there in its position.

The transposing carriage 46 of the vertical transposing device 42 in the drying tunnel 24 is now, first of all, moved vertically downwards into its lower delivery position.

The loaded workpiece-carriers 20 are then conveyed, on the lower tunnel conveyor 40, in the latter's direction of conveyance T4, whereby the loaded workpiece-carrier 20 adjacent to the transfer chamber 26 is transferred to the lower conveying support 56 of the conveying carriage 52 of the transfer apparatus 50. At the same time, the loaded workpiece-carrier 20 on the transposing carriage 46 of the vertical transposing device 42 moves up onto the lower tunnel conveyor 40. The transposing carriage 46 is then moved vertically upwards into its upper receiving position.

The vehicle wheels 12 on the workpiece-carrier 20, which is now arranged on the lower conveying support 56 of the conveying carriage 52, have passed through the drying tunnel 24, as a result of which the desired drying process has been completed.

The workpiece-carriers 20 on the upper tunnel conveyor 38 are now conveyed, in the latter's direction of transport T3, in the direction of the vertical transposing device 42, whereby a workpiece-carrier 20 moves up onto the transposing support 48 of said device. At the same time, the workpiece-carrier 20 on the upper conveying support 54 of the conveying carriage 52 of the transfer apparatus 50 is moved from the latter up onto the upper tunnel conveyor 38.

After that, the conveying carriage 52 of the transfer apparatus 50 is moved into its central working position, and the workpiece-carrier 20 on the lower conveying support 56 is transferred, in the horizontal direction, to the transfer station 36.

The conveying carriage 52 of the transfer apparatus 50 is now moved into its lowermost working position, and the workpiece-carriers 20 on the feed conveyor 28 are moved, in the latter's direction of transport T1, in the direction of the conveying carriage 52, whereby a loaded workpiece-carrier 20 moves up onto the upper conveying support 54 of said carriage. The conveying carriage 52 is then moved into its uppermost working position again.

At the same time, the workpiece-carrier 20 is transferred from the second conveying position 32*b* of the transverse conveying station 32 to the feed conveyor 28, so that the second conveying position 32*b* is now free.

The transverse conveying station 32 now brings the workpiece-carrier 20, which has been freshly loaded from outside with vehicle wheels 12 which are still to be dried, from the first conveying position 32*a* into the second conveying position 32*b*. The workpiece-carriers 20 on the discharging conveyor 30 are then moved in the direction of the transverse conveying station 32 and the foremost workpiece-carrier 20 in the direction of transport T2 is transferred to said transverse conveying station 32, where it assumes the first conveying position 32*a* in front of the access 34 in the dryer housing 14. In the process, the workpiece-carrier 20 on the transfer station 36 is given a subsequent push onto the discharging conveyor 28.

The handling robot 62 now receives the dried vehicle wheels 12 of the workpiece-carrier 20 in the first conveying position 32*a* of the transverse conveying station 32, whereby the workpiece-carrier 20 remains in the pre-heating and discharging zone 22. The handling robot 62 transfers these dried vehicle wheels 12 to the empty workpiece-carrier 68 which is waiting on the workpiece-conveyor 66. The latter conveys the workpiece-carrier 68, which is now loaded with the dried vehicle wheels 12, onwards, for example to a cooling zone for said wheels. In the process, a new workpiece-carrier 68, which, however, carries with it vehicle wheels 12 to be dried, moves up instead in front of the handling robot 62, and the cycle explained above is repeated.

By means of the transposing apparatus 60, it is thus possible to both transfer vehicle wheels 12 which are to be dried to a workpiece-carrier 20 which is located in the dryer chamber 16, and to remove dried vehicle wheels 12 from a workpiece-carrier 20 which is located in said dryer chamber 16. As a result of this, it is possible for the workpiece-carriers 20 to be conveyed in circulation through the dryer chamber 16 without leaving said chamber.

As a result, the workpiece-carriers 20 only cool down slightly before they are fed into the drying tunnel 24 again, and a lower input of heat into the workpiece-carriers 20 takes place than in the case in which workpiece-carriers are not guided in circulation, but are guided through, a drying oven. In the case of the temperatures of 70° C. to 80° C., which are indicated above by way of an example, in the pre-heating and discharging zone 22, and of about 180° C. in the drying tunnel 24, the workpiece-carriers 20 only cool down to about 150° C., for example. In a modification of the drying oven 10 explained above, it is also possible for there to be a number of accesses and not just the single access 34. For example, there may be a second access in front of the access 34 in the direction of transport T2, via which a second transposing apparatus is capable of reaching the discharging conveyor 30. It is then possible for vehicle wheels 12 which have already been dried to be removed, by means of the second transposing apparatus via the second access, from a workpiece-carrier 20 on the discharging conveyor 30, and for vehicle wheels 12 which are to be dried to be brought, in a synchronized manner via the access 34, onto a workpiece-carrier 20 which has already been emptied. As a result of this, it is possible to increase the number of cycles and thereby the throughput of the drying oven 10.

In another modification, which is intentionally not shown, the access 34 is constructed as a lock, by means of which the discharge of heat via the opening to the pre-heating and discharging zone 22 is reduced. A lock of this kind may be constructed, for example, as a simple roller gate. If a number of accesses are present, these may accordingly all be in the form of a lock of this kind.

Figure 5:
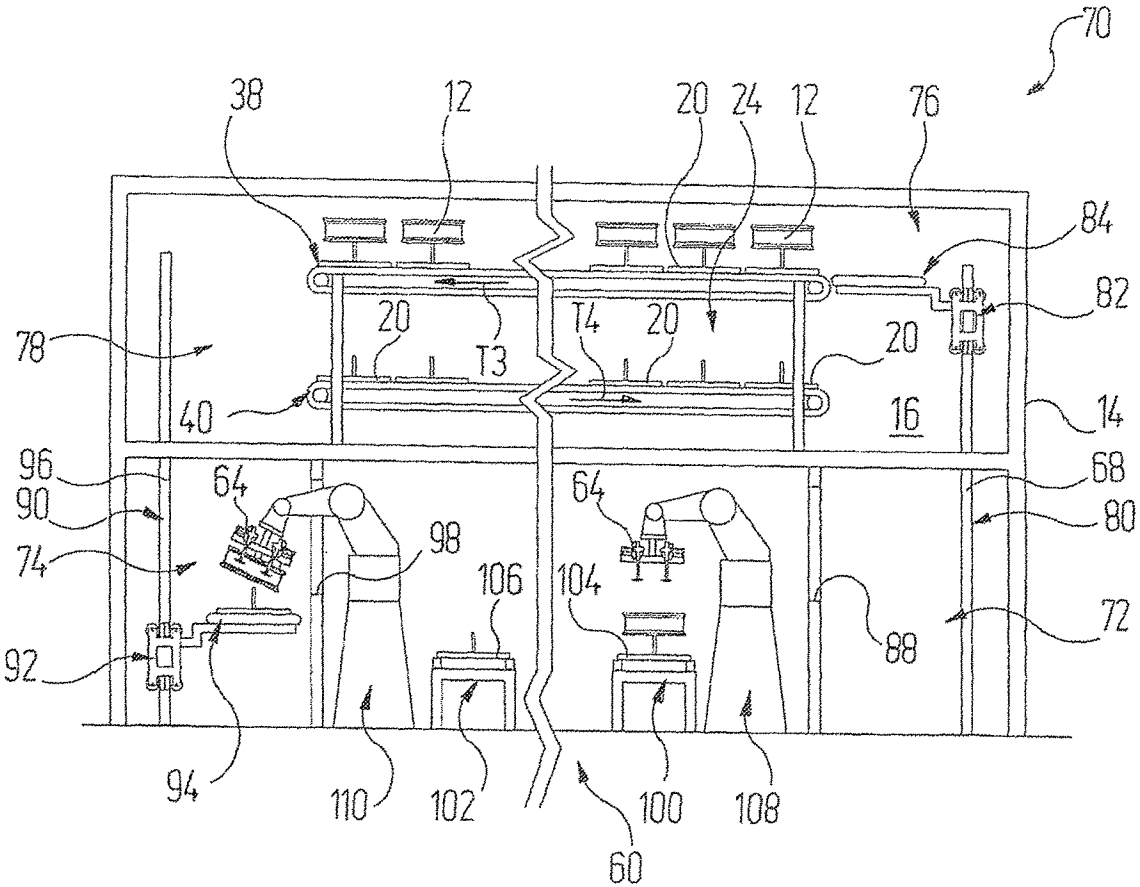
FIG. 5 shows a vertical section corresponding to FIG. 2 through a drying oven for vehicle wheels according to a second exemplary embodiment.

A drying oven 70 having a different conveying design, compared to the drying oven 10, is shown in FIG. 5 as a second exemplary embodiment. In the drying oven 70, components which correspond to those of the drying oven 10 according to FIGS. 1 to 4 bear the same reference numerals. In this connection, what has been stated above regarding the drying oven 10 also applies in a corresponding manner, mutatis mutandis, to the drying oven 70, provided nothing to the contrary is explained below.

In the case of the drying oven 70, the joint pre-heating and discharging zone 22 of the dryer chamber 16 is broken up and divided spatially into a separate pre-heating zone 72 and a separate discharging zone 74 belonging to the dryer chamber 16.

Instead of the transfer chamber 26, there is now provided a feed chamber 76 next to one end of the drying tunnel 24, while a delivery chamber 78 is arranged next to the opposite end of said drying tunnel 24. The pre-warming zone 72 is located vertically below the feed chamber 76, while the discharging zone 74 lies vertically below the delivery chamber 78.

Instead of the transfer apparatus 50 having the conveying carriage 52 and the two conveying supports 54 and 56, there is now a feed apparatus 80 having a single-storey feed carriage 82 which carries with it only a single carriage support 84. Said carriage support 84 is capable of both delivering a workpiece-carrier 20 in the direction of the direction of transport T3 of the upper tunnel conveyor 38, and of receiving a workpiece-carrier 20 from the direction of the direction of transport T4 of the lower tunnel conveyor 40. The feed carriage 82 can be moved vertically along a guide structure 86 which extends upwards from the pre-heating zone 72 into the feed chamber 76 and connects them together for conveying purposes. In this connection, the following three working positions of the feed carriage 82 are now of interest:

In a first, uppermost working position, the carriage support 84 of the feed carriage 82 is in alignment, for conveying purposes, with the upper tunnel conveyor 38, as is shown in FIG. 5.

In a second, central working position of the feed carriage 82, the latter's carriage support 84 is in alignment, for conveying purposes, with the lower tunnel conveyor 40 in the drying tunnel 24.

In a third, lowermost working position of the feed carriage 82, the latter is located in the pre-heating zone 72 in front of a feed access 88 belonging to the dryer housing 14, which access leads to said pre-heating zone 72 and may be closed, for example, by a roller gate.

Instead of the vertical transposing device 42 of the drying oven 10, with the aid of which workpiece-carriers 20 can be transposed from the upper tunnel conveyor 38 to the lower tunnel conveyor 40, there is provided, in the case of the drying oven 70, a delivery apparatus 90 which likewise constitutes a vertical conveyor and which comprises a delivery carriage 92 having likewise only a single carriage support 94. The carriage support 94 of the delivery apparatus 90 is capable of both receiving a workpiece-carrier 20 from the direction of the direction of transport T3 of the upper tunnel conveyor 38 and of delivering a workpiece-carrier 20 in the direction of the direction of transport T4 of the lower tunnel conveyor 40.

The delivery carriage 92 can be moved vertically along a guide structure 96 which extends upwards from the discharging zone 74 into the delivery chamber 78 and connects them to one another for conveying purposes. In this connection, attention is to be drawn to the following three working positions of the delivery carriage 92 in the case of the delivery apparatus 90:

In a first, uppermost working position, the carriage support 94 of the delivery carriage 92 is in alignment, for conveying purposes, with the upper tunnel conveyor 38.

In a second, central working position of the delivery carriage 92, the latter's delivery support 94 is in alignment, for conveying purposes, with the lower tunnel conveyor 40 in the drying tunnel 24.

In a third, lowermost working position of the delivery carriage 92, the latter is located in the discharging zone 74 in front of a delivery access 98 of the dryer housing 14, which access leads to said discharging zone 74 and, once again, can be closed by means of a roller gate.

Instead of the workpiece-conveyor 66, there are present, in the case of the drying oven 70, a feed conveyor 100 and a delivery conveyor 102, which are each constructed as chain conveyors. The feed conveyor 100 conveys vehicle wheels 12 which are to be dried towards the drying oven 70 on workpiece-carriers 104, and the delivery conveyor 102 conveys dried vehicle wheels 12 away from said drying oven 70 on separately guided workpiece-carriers 106.

In the case of the drying oven 70, the transposing apparatus 60 comprises a feed robot 108, which is arranged in front of the feed access 88, and a removal robot 110, which is arranged in front of the delivery access 98, the two robots 108 and 110 corresponding structurally to the handling robot 62 of the drying oven 10.

The feed robot 108 is capable, on the one hand, of reaching the carriage support 84 of the feed carriage 82 of the feed apparatus 80 through the feed access 88. On the other hand, the feed conveyor 100 is located within the working range of the feed robot 108. Similarly, the removal robot 110 is capable of reaching, on the one hand, the carriage support 94 of the delivery carriage 92 of the delivery apparatus 80 through the delivery access 98 and, on the other hand, the delivery conveyor 102.

The drying oven 70 described above is now operated as follows:

The arrangement, which is shown in FIG. 5, of the individual conveying components and also workpiece-carriers 20, with or without vehicle wheels 12, will be assumed as the starting situation.

Accordingly, there are located on the upper tunnel conveyor 38 workpiece carriers 20 with vehicle wheels 12 which are just being dried, whereas only unloaded workpiece-carriers 20 are transported on the lower tunnel conveyor 20.

In its uppermost working position, the feed carriage 82 of the feed apparatus 80 is located next to the upper tunnel conveyor 38 and is empty, that is to say there is likewise no workpiece-carrier on the carriage support 84 of said conveyor. On the feed conveyor 100, outside the dryer housing 14, a loaded workpiece-carrier 104 is positioned in front of the feed robot 108, the gripping unit 64 of which is, in turn, empty.

The delivery carriage 92 of the delivery apparatus 90, on the other hand, has assumed its lowermost working position next to the delivery access 98, and carries a workpiece-carrier 20, whereby the removal robot 110 has received vehicle wheels 12, which have just been dried, from said workpiece-carrier 20. Positioned on the delivery conveyor 102, next to said removal robot 110, is an empty workpiece-carrier 106.

The removal robot 110 first of all guides the dried vehicle wheels 12 through the delivery access point 98 and out of the discharging zone 74, and thereby out of the dryer chamber 16, and deposits them on the workpiece-carrier 106. The two carriages 82 and 92 of the feed apparatus 80 and the delivery apparatus 90 then move into their central working position, next to the lower tunnel conveyor 40 in the drying tunnel 24 in each case.

The workpiece-carriers 20 on the lower tunnel conveyor 40 are now conveyed in the latter's direction of transport T4, whereby an unloaded workpiece-carrier 20 moves up onto the carriage support 84 of the feed carriage 82. At the same time, the unloaded workpiece-carrier 20 on the carriage support 94 of the delivery carriage 92 is moved up onto the lower tunnel conveyor 40, so that said delivery carriage 92 is empty.

The feed carriage 82 then moves, with the unloaded workpiece-carrier 20, into its lowermost working position in front of the feed access 88, where it is loaded, by means of the feed robot 108, with vehicle wheels 12 which are to be dried.

Both the feed carriage 82, which is now loaded, and the empty delivery carriage 92 then move into their uppermost working position, in each case, next to the upper tunnel conveyor 38. The loaded workpiece-carriers 20 on the upper tunnel conveyor 38 are now conveyed in the latter's direction of transport T3, whereby a loaded workpiece-carrier 20 moves up onto the carriage support 94 of the delivery carriage 92, and the loaded workpiece-carrier 20 moves up from the carriage support 84 of the feed carriage 82 onto the upper tunnel conveyor 38, so that the feed carriage 82 is now empty, as is shown in FIG. 5.

After this, the delivery carriage 92 moves into its lowermost working position in front of the delivery access 98 in the dryer housing 14, where the vehicle wheels 12 are received by the removal robot 110 and transferred to the delivery conveyor 102.

The cycle is then repeated.

In the case of the drying oven 70 too, it is possible, by means of the transposing apparatus 60, both to transfer vehicle wheels 12 which are to be dried to a workpiece-carrier 20 which is located in the dryer chamber 16, and to remove dried vehicle wheels 12 from a workpiece-carrier 20 which is located in said dryer chamber. As a result of this, it is possible for the workpiece-carriers 20 to be conveyed in circulation through the dryer chamber 16 without leaving said chamber.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A device for drying workpieces comprising:

a) a dryer housing which borders a dryer chamber and has at least one access to the dryer chamber, wherein the dryer chamber comprises
   - aa) a pre-heating and discharge zone comprising a first conveyor and a second conveyor,
   - ab) a drying tunnel arranged vertically above the pre-heating zone, the drying tunnel being of a two-story configuration and comprising a first drying tunnel conveyor arranged vertically above a second drying tunnel conveyor,
   - ac) a transfer apparatus for vertically moving workpiece-carriers loaded with workpieces from
     - aca) the first conveyor to the first drying tunnel conveyor, and
     - acb) the second drying tunnel conveyor to the second conveyor, and
   - ad) a vertical conveyor for vertically moving workpiece-carriers loaded with workpieces from the first drying tunnel conveyor to the second drying tunnel conveyor;

b) a transposing apparatus which
   - ba) transfers workpieces to be dried to a workpiece-carrier which is located in the dryer chamber; and
   - bb) removes dried workpieces from a workpiece-carrier which is located in said dryer chamber; so that c) the workpiece-carriers can be conveyed in circulation through the dryer chamber without leaving said chamber.

2. The device according to claim 1, wherein a temperature in the pre-heating zone is lower than a temperature in the drying tunnel, and said pre-heating zone is accessible from outside via the at least one access.

3. The device according to claim 1, wherein the transfer apparatus has a vertically movable conveying carriage, having a first conveying support and a second conveying support which are arranged vertically one above the other, whereby it is possible to position the conveying carriage in such a way that the first conveying support is capable of cooperating with the first tunnel conveyor and the second conveying support is capable of cooperating with the second tunnel conveyor.

4. A method for drying workpieces, the method comprising the steps of:

a) conveying workpiece-carriers through a pre-heating zone on a first conveyor, b) moving the workpiece-carriers vertically from the first conveyor to a first drying tunnel conveyor in a drying tunnel;

c) conveying the workpiece-carriers through the first drying tunnel conveyor;

d) moving the workpiece-carriers vertically from the first drying tunnel conveyor to a second drying tunnel conveyor arranged beneath the first drying tunnel conveyor;

e) conveying the workpiece-carriers through the second drying tunnel conveyor;

f) moving the workpiece-carriers from the second drying tunnel conveyor to a second conveyor in a discharge zone, the second conveyor being positioned adjacent the first conveyor;

whereby:

g) workpieces to be dried are transferred to a workpiece-carrier through an access which is located in a dryer chamber which comprises the pre-heating chamber and the drying tunnel; and h) dried workpieces are removed from a workpiece-carrier through the access which is located in said dryer chamber without requiring removal of the workpiece-carriers from the dryer chamber.

5. The method according to claim 4, wherein a temperature in a pre-heating zone is lower than a temperature in a drying tunnel, and the pre-heating zone is accessible from outside via at least one access.

6. The method according to claim 5, wherein the drying tunnel is arranged at a different vertical level than the pre-heating zone.

7. The method according to claim 5, wherein the workpiece-carriers are conveyed from the first drying tunnel conveyor to the second drying tunnel conveyor by a vertical conveyor.

8. The method according to claim 7, wherein the workpiece-carriers are conveyed out of the pre-heating zone and into the drying tunnel and vice versa by a transfer apparatus which comprises a conveying carriage having a first conveying support and a second conveying support which are arranged vertically one above the other, whereby the conveying carriage may be positioned in such a way that the first conveying support is capable of cooperating with the first tunnel conveyor and the second conveying support is capable of cooperating with the second tunnel conveyor.

9. A device for drying workpieces comprising:

a) a dryer housing which borders a dryer chamber and has an access to the dryer chamber;

b) a conveying system which conveys workpiece-carriers loaded with workpieces through the dryer chamber;

c) a transposing apparatus;

d) a transverse conveying apparatus arranged adjacent the access, the transverse conveying apparatus providing a first conveying position and a second conveying position for workpiece-carriers, wherein the transposing apparatus removes dried workpieces from a workpiece-carrier through the access when the workpiece carrier is in the first conveying position, and the transposing apparatus transfers workpieces to be dried to the workpiece-carrier through the access when the workpiece carrier is in the second conveying position, so that e) the workpiece-carriers can be conveyed in circulation through the dryer chamber without leaving the dryer chamber.

10. The device according to claim 9, wherein the dryer chamber comprises a pre-heating zone and a drying tunnel connected to the latter, whereby there prevails, in said pre-heating zone, a temperature which is lower than a temperature in the drying tunnel, and said pre-heating zone is accessible from outside via the access.

11. The device according to claim 10, wherein the drying tunnel is arranged at a different vertical level than the pre-heating zone.

12. The device according to claim 10, wherein the drying tunnel is of two-story construction and comprises a first tunnel conveyor and a second tunnel conveyor for workpiece-carriers, whereby the tunnel conveyors are arranged vertically one above the other and workpiece-carriers can be conveyed from the first tunnel conveyor to the second tunnel conveyor by means of a vertical conveyor.

13. The device according to claim 12, wherein a transfer apparatus having a vertically movable conveying carriage is arranged in the dryer which conveys apparatus workpiece-carriers out of the pre-heating zone and into the drying tunnel and vice versa, and the conveying carriage of which apparatus carries with it a first conveying support and a second conveying support which are arranged vertically one above the other, whereby it is possible to position the conveying carriage in such a way that the first conveying support is capable of cooperating with the first tunnel conveyor and the second conveying support is capable of cooperating with the second tunnel conveyor.

14. The device of claim 13, wherein the transfer apparatus is located adjacent the access.

15. The device according to claim 10, wherein the pre-heating zone is arranged adjacent a discharge zone, the pre-heating zone comprising a first conveyor and the discharge zone comprising a second conveyor.

16. The device according to claim 15, wherein the workpiece carrier is arranged adjacent the second conveyor when in the first conveying position and the workpiece carrier is arranged adjacent the first conveyor when in the second conveying position.

17. The device according to claim 16 wherein the transverse conveying station is arranged transverse to a direction of travel of the first conveyor and transverse to a direction of travel of the second conveyor.

* * * * *